United States Patent [19]

Bahr et al.

[11] 4,425,181

[45] Jan. 10, 1984

[54] OUTSERT APPLICATOR APPARATUS

[75] Inventors: Melford J. Bahr, Corcoran; Cyril A. Ehalt, Plymouth; Wayne R. Geist, Rogers, all of Minn.

[73] Assignee: MGS Machine Corporation, Minneapolis, Minn.

[21] Appl. No.: 359,862

[22] Filed: Mar. 19, 1982

[51] Int. Cl.[3] ..... B65C 9/14; B65C 9/36

[52] U.S. Cl. ..... 156/497; 156/557; 156/568; 156/571; 156/572; 156/DIG. 31; 156/DIG. 42; 271/14; 271/95

[58] Field of Search ..... 156/364, 542, 557, 567, 156/568, 571, 572, DIG. 31, DIG. 42, 497; 271/5, 14, 95

[56] References Cited

U.S. PATENT DOCUMENTS

| | | | |
|---|---|---|---|
| 3,025,211 | 3/1962 | Winn | 156/542 |
| 3,129,130 | 4/1964 | Lerner et al. | 156/572 |
| 3,549,459 | 12/1970 | Whitecar | 156/572 |
| 3,565,721 | 2/1971 | Spaulding et al. | 156/557 |
| 4,089,725 | 5/1978 | Crankshaw et al. | 156/542 |
| 4,236,954 | 12/1980 | Edwards | 156/572 |
| 4,265,695 | 5/1981 | Hurley et al. | 156/571 |
| 4,287,016 | 9/1981 | Kerwin et al. | 156/571 |
| 4,293,365 | 10/1981 | Geyser et al. | 156/571 |

OTHER PUBLICATIONS

Brochure, "Thiele Placers" re Model 200 Automatic Rotary Outserter.

Brochure, NJM, Inc., "186 Pony Express Model T--Floor Plan".

*Primary Examiner*—Michael G. Wityshyn

*Attorney, Agent, or Firm*—Merchant, Gould, Smith, Edell, Welter & Schmidt

[57] ABSTRACT

An apparatus (10) for simultaneously applying individual outserts to multiple containers of pharmaceuticals includes a conveyor (12) for advancing the containers along an input path and magazines (22) containing the outserts. The containers are stopped in groups by a gate assembly (18) opposite to a transfer assembly (20) including a rotatable pick up arm (72) mounted for reciprocation between a retracted position adjacent to the magazines (22) and an extended position adjacent to the container input path. Vacuum cups (76) are provided on the pick up arm (72) for engaging the outserts, and pinion and a drive pin arrangement (100, 102) is utilized to control rotation of the pick up arm to reorient the outserts only during an intermediate portion of travel between linear motion at the extended and retracted positions to facilitate proper engagement between the outserts and the vacuum cups. A glue pot (96) is preferably located adjacent to the transfer assembly (20) for applying adhesive to the outserts before application to the containers.

5 Claims, 7 Drawing Figures

FIG. 5
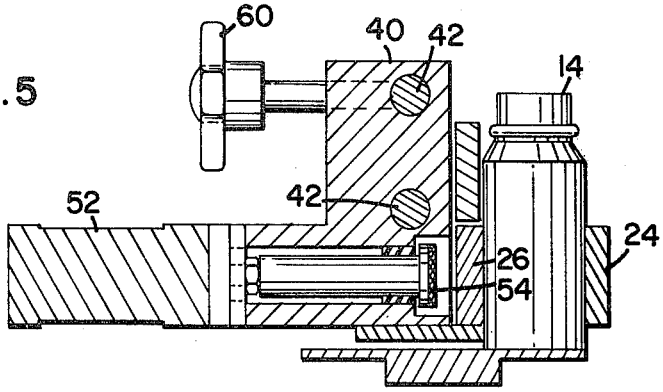
FIG. 6
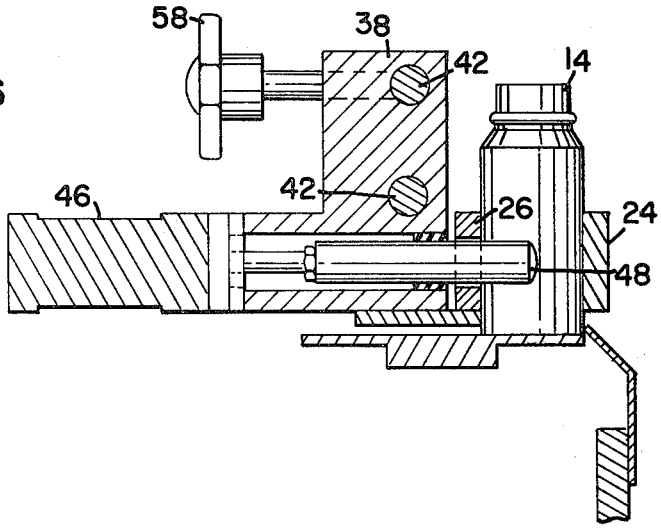
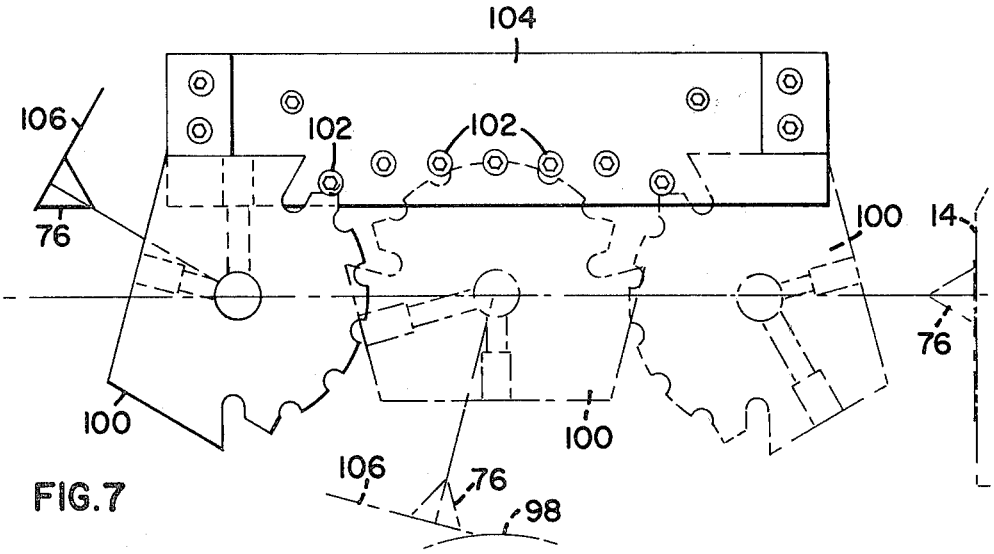
FIG. 7

OUTSERT APPLICATOR APPARATUS

TECHNICAL FIELD

The present invention relates generally to a transfer device, and more particularly to an apparatus for individually applying outserts from magazines to containers indexed along a path of conveyance.

BACKGROUND ART

In the pharmaceutical industry, "outserts" must be packaged with prescription drugs for use by dispensing pharmacists. Such outserts contain information about the chemical composition of the drugs together with dosage and administration information and warnings about possible side effects in connection with their use. Inclusion of appropriate outserts, in accordance with the regulations of the Food and Drug Administration (FDA), is thus an important aspect of the packaging and distribution of pharmaceuticals.

Outserts can be packaged with the pharmaceuticals in two basic manners; either in individual cartons together with the containers of pharmaceuticals, or by application directly to the containers. The use of cartons, of course, involves additional cost and the machinery for placing outserts in such cartons on a production line basis can be expensive, complicated and difficult to maintain. Oftentimes, however, containers of pharmaceuticals are not packaged in individual cartons but are shipped with multiple containers to a case with an outsert applied directly to each container. When outserts are applied to the outsides of the containers, careful attention must therefore be given to effecting a reliable connection which will withstand the rigors of handling and yet permit detachment by the pharmacist without destroying the outsert.

Various machinery has been available heretofore for applying outserts directly to containers by means of hot melt adhesives, double-face tape and heat shrink material techniques; however, the devices of the prior art have tended to be unduly complicated and expensive and have not been adapted for convenient changeover to accomodate various sizes and types of outserts and containers. Outserts are typically formed of paper while the containers are usually constructed from plastic or glass, and it will be appreciated that outserts and containers come in a wide variety of sizes and shapes. In addition, manufacturing variations in the outserts and containers must be taken into account. Hot melt adhesive is generally less expensive than double-face tape and heat shrink materials, but requires proper application of sufficient adhesive to the outserts as well as proper contact between the outserts and the containers in order to achieve reliable adhesive connection. Some of the prior machinery is relatively speedy but unreliable due to either inadequate adhesive and/or improper application of adhesive to the outserts, or inadequate contact and thus weak connection between the outserts and containers.

A need has thus arisen for an improved outsert applicator apparatus by which outserts can be reliably applied to multiple containers simultaneously and which is adapted to facilitate rapid changeover to compensate for outserts and containers of different sizes.

SUMMARY OF INVENTION

The present invention comprises an outsert applicator apparatus which overcomes the foregoing and other difficulties associated with the prior art. In accordance with the invention, gate and transfer assemblies are located on opposite sides of a conveyor defining a path along which containers are advanced for direct application of outserts thereto. A pickup arm is supported on the transfer assembly, which is mounted for reciprocal movement between magazines of outserts and the gate assembly, which functions to selectively immobilize a predetermined number of containers in position adjacent to the transfer assembly. Upon positioning of the containers, the transfer assembly is actuated to first engage outserts in the magazines by means of vacuum suction cups then rotate the outserts into position, and finally apply the outserts to the containers. After application of the outserts, the transfer assembly returns to a ready position adjacent to the magazines. Rotation of the pickup arm during reciprocation of the transfer assembly is controlled by a unique sprocket and drive pin arrangement which effects rotary motion of the pickup arm between substantially linear motions thereof at the stroke extremes of the transfer assembly to facilitate positive contact with the outserts and engagement thereof with the containers. Upon application of the outserts to the containers, the vacuum to the pickup arm is interrupted to allow withdrawal of the transfer assembly, after which the gate assembly is opened to release the containers with the outserts applied thereto and receive other containers for the next cycle.

BRIEF DESCRIPTION OF DRAWINGS

A better understanding of the invention can be had by reference to the following Detailed Description in conjunction with the accompanying Drawings, wherein:

FIGS. 5 and 6 are sectional views taken along lines 5—5 and 6—6, respectively, of FIG. 4 in the direction of the arrows; and FIG. 7 is an illustration showing the linear-rotary-linear motion of the pickup arm on the transfer assembly.

DETAILED DESCRIPTION

Figure 1:
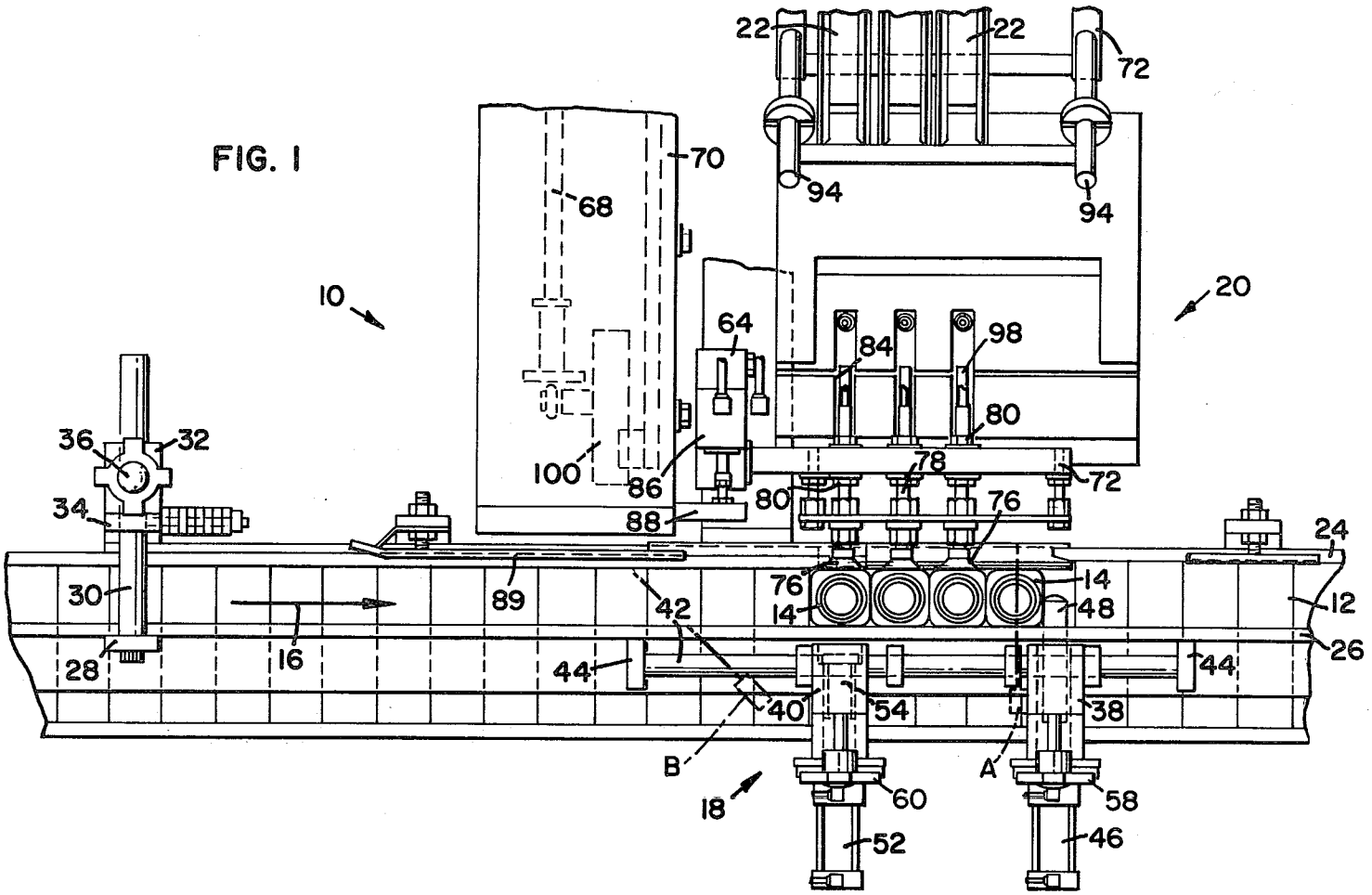
FIG. 1 is a partial top view of the outsert applicator apparatus incorporating the invention.

Referring now to the Drawings, wherein like reference numerals designate like or corresponding elements throughout the several views, and particularly referring to FIG. 1, there is shown an outsert applicator apparatus 10 incorporating the invention. Apparatus 10 comprises a generally horizontal conveyor 12 for advancing containers 14 of pharmaceuticals or the like in the direction indicated by arrow 16. A gate assembly 18 is located along the input path defined by conveyor 12 for selectively interrupting advancement of one or more and preferably several containers 14 adjacent to an opposing transfer assembly 20, which functions to pick up outserts from magazines 22 and simultaneously apply them to the containers, following which the containers with the outserts applied thereto are released and the next group of containers are received from the gate assembly for application of outserts.

As will be explained more fully hereinafter, the applicator apparatus 10 herein is adapted to apply individual outserts, labels or the like to multiple containers 14 simultaneously, and incorporates a unique mechanism to control movement of the pick up arm as the transfer assembly 20 reciprocates between magazines 22 and gate assembly 18. Further, apparatus 10 is adapted to facilitate changeover to accommodate various types and sizes of outserts and containers 14. Although apparatus 10 is particularly adapted for use in the pharmaceutical industry to apply outserts to containers of prescription drugs, it will be appreciated that the invention can be utilized in a variety of packaging applications for applying labels and the like directly to containers of various types.

Figure 4:
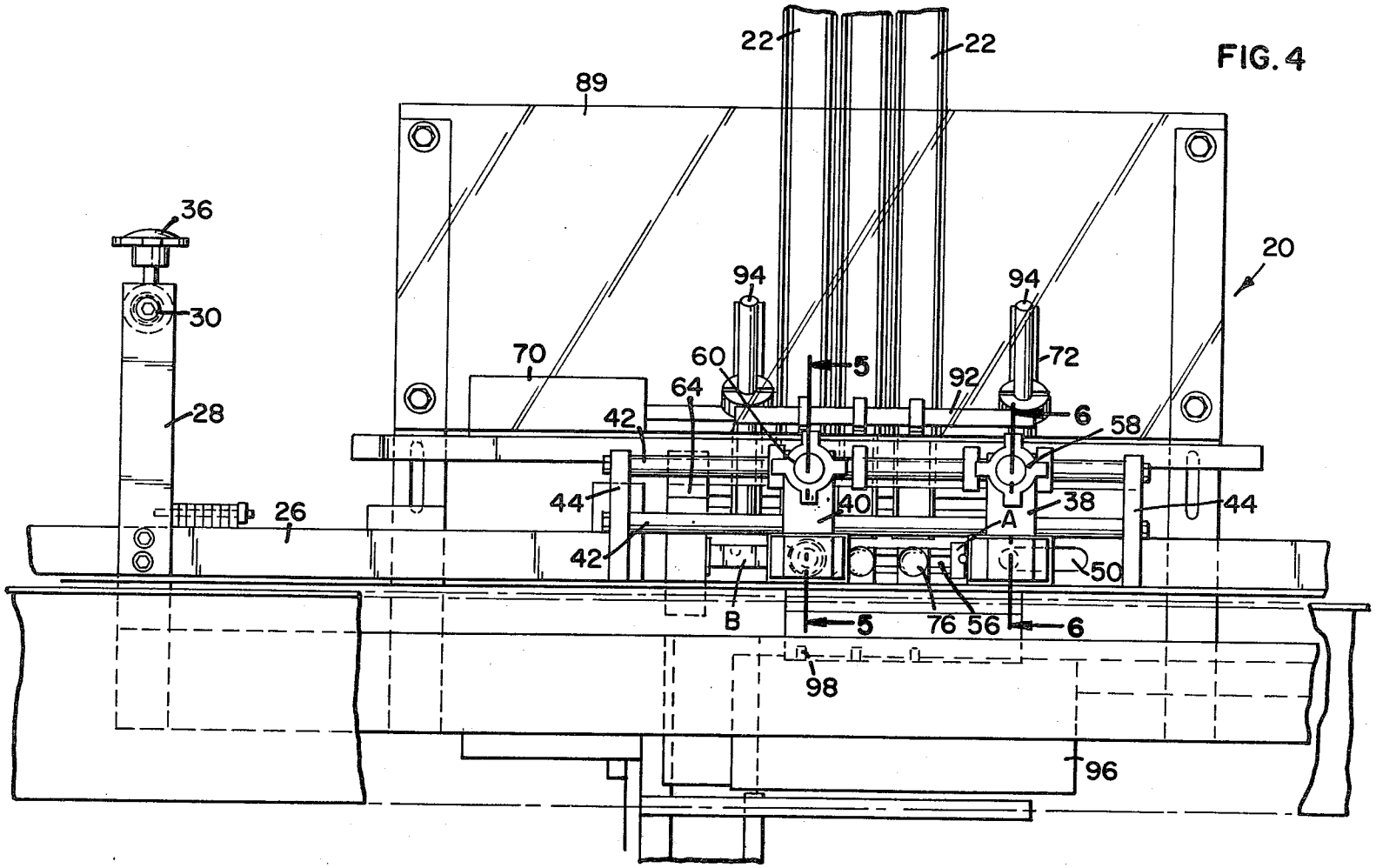
FIG. 4 is a front elevational view of the outsert applicator apparatus of the invention.

Referring now to FIGS. 1 and 4, conveyor 12 comprises a conveyor of the table top type having an endless belt driven about a course. Conveyor 12 is of substantially conventional construction and suitable conveyors for this purpose are available from a variety of commercial sources. The belt of conveyor 12 is shown as being segmented, however, a continuous belt could also be utilized and it will be understood that the particular type of belt is not critical to practice of the invention provided it serves the purpose of conveying containers 14 in the feed direction indicated by arrow 16.

A pair of side rails 24 and 26 are provided with conveyor 12 to define a path along which the containers 14 are conveyed in single file when viewed longitudinally or side by side when viewed laterally. Side rail 24 is secured to the supports for conveyor 12 along one side of the conveyor and is thus mounted in fixed position, while side rail 26 is adjustable. Side rail 26 is supported immediately above conveyor 12 on a pair of legs 28, only one of which is shown, which depend from shafts 30 extending through clamp blocks 32 mounted on corresponding legs 34 attached to the fixed rail 24. Rail 26 can thus be positioned as desired with respect to rail 24 and then locked in place by means of clamp handles 36 to define a conveyance path of sufficient width to accommodate containers 14 one behind the other without undue lateral play. This adjustability comprises an important feature of the present invention.

Referring now to FIGS. 1 and 4 in conjunction with FIGS. 5 and 6, the gate assembly 18 is mounted on the movable guide rail 26. Gate assembly 18 includes a pair of clamp blocks 38 and 40 mounted for movement along a pair of longitudinal rails 42 extending between uprights 44. Mounted on clamp block 38 is a double acting cylinder 46 which is coupled to a gate or stop pin 48 for selective extension through a slot 50 in rail 26, as is best seen in FIG. 4, into the path of container conveyance. FIGS. 1 and 6 show stop pin 48 in the extended position. Clamp block 40 includes a double acting cylinder 52 actuating a clamp foot 54 for selective extension through a slot 56, as is best seen in FIG. 4, into engagement with an adjacent container 14. FIGS. 1 and 5 show clamp foot 54 in the retracted position. Blocks 38 and 40 can be selectively clamped in position along rails 42 by means of handles 58 and 60, respectively, to provide adjustability for the size of containers 14 and the number of containers in each grouping, which also comprises an important feature of the invention.

Stop pin 48 of gate assembly 18 functions as a gate to interrupt conveyance of the leading container 14 in a group, while clamp foot 54 functions to immobilize the last container in each grouping so that the leading and trailing containers and those in between are securely held in place as the outserts are applied by transfer assembly 20. As illustrated, set collars can be provided on the upper slide rail 42 to facilitate adjustment of clamp blocks 38 and 40.

Photosensors A and B, as are best seen in FIG. 4, are preferably included in gate assembly 18 to detect containers 14. The purpose of photosensor A is to sense a container 14 engaged against stop pin 48, while photosensor B provides a searching function to sense the presence of containers approaching gate assembly 18. Photosensors A and B can also be used for counting purposes, if desired. Proximity photoelectric switches of the type available from Banner Engineering Corp. of Minneapolis, Minn., can be used for photosensors A and B, for example.

Figure 2:
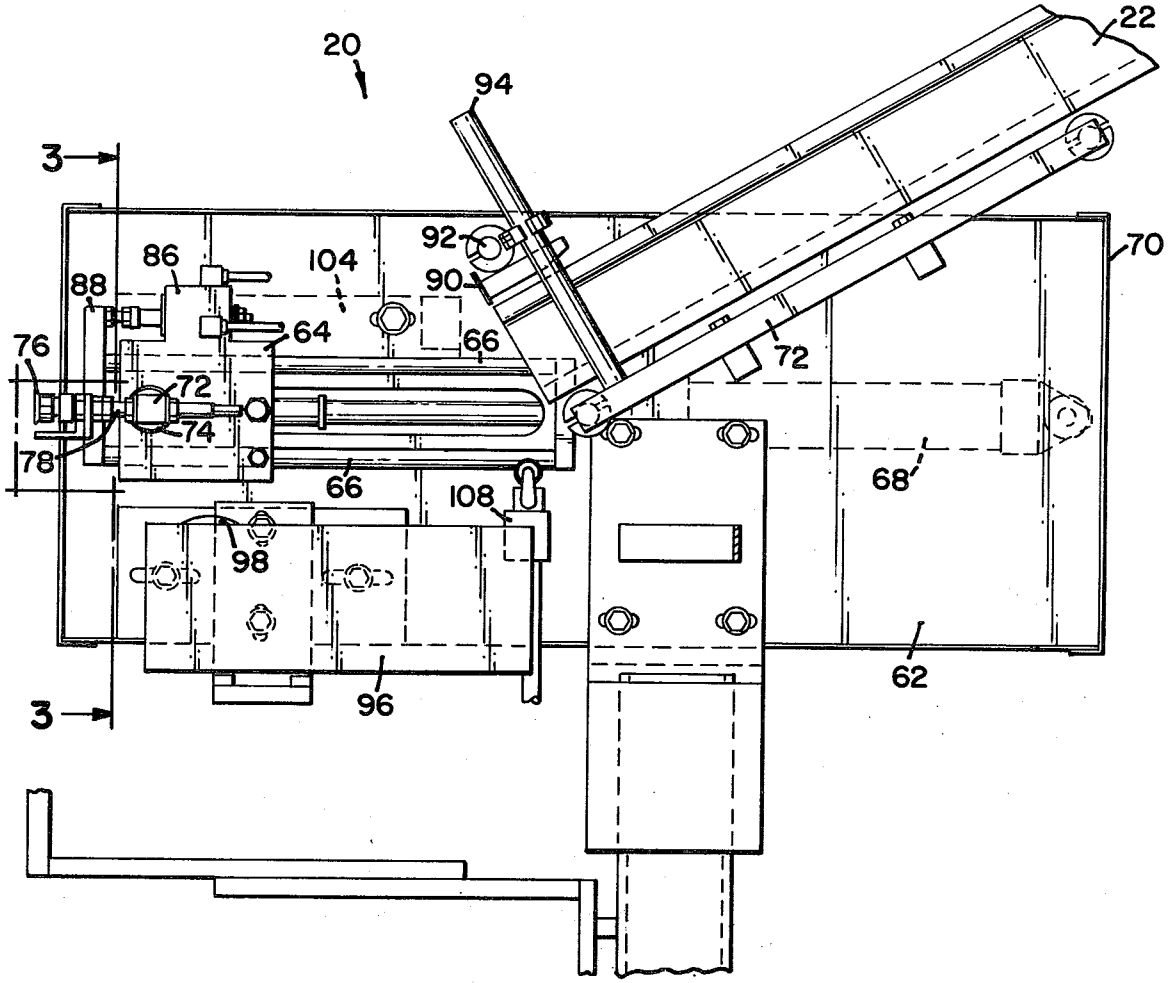
FIG. 2 is a partial side elevation view of the outsert applicator apparatus herein, showing the transport assembly in the extended position.
Figure 3:
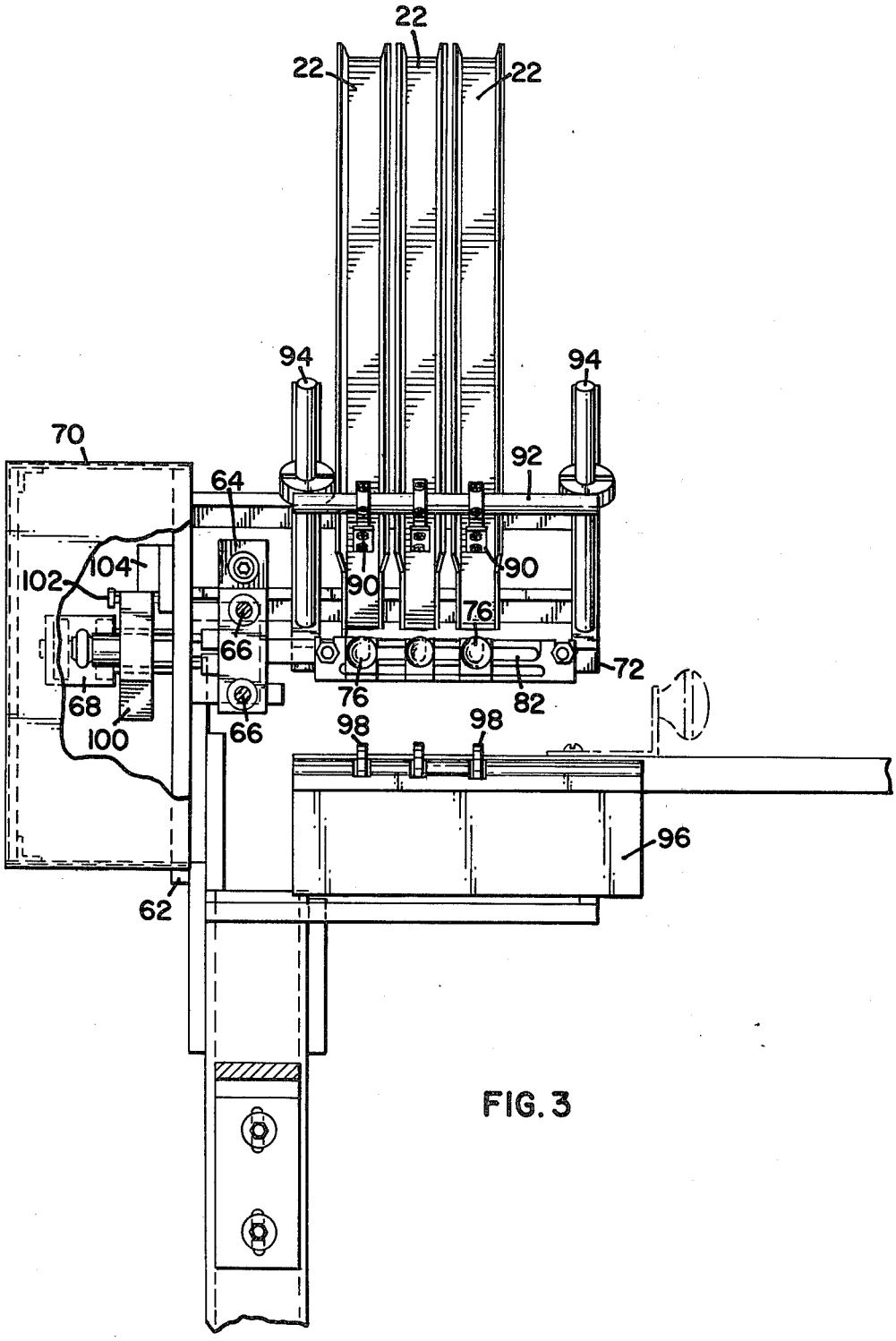
FIG. 3 is a sectional view taken along lines 3—3 of FIG. 2 in the direction of the arrows.

Turning to FIGS. 1–3, the transfer assembly 20 of apparatus 10 includes a generally vertical fixed support plate 62 extending transversely to the conveyor 12 across from the gate assembly 18. A slide block 64 is mounted for reciprocal movement, between an extended position as shown in FIG. 2 and a retracted position adjacent to the magazines 22, along rods 66 mounted on one side of the support plate 62. A double acting cylinder 68, located within a housing 70 on the other side of support plate 62, is coupled to an arm on the slide plate 64 extending through a slot in the support plate.

A pick up arm 72 extends laterally outward from the slide plate 64 and is journaled for rotation therein by means of bearing 74 as is best seen in FIG. 2. Vacuum cups 76, corresponding in number to magazines 22 and thus the number of containers 14 to which outserts are to be applied simultaneously, are supported on the arm 72. In particular each vacuum cup 76 is supported at the end of a externally threaded tubular member 78 secured in adjustable relationship by jam nuts 80 along a lateral slot 82 in arm 72. The opposite ends of tubular member 78 are connected to a source of vacuum pressure (not shown) by means of lines 84. Transfer assembly 20 thus comprises a reciprocal slide block 64 with a rotatable pick up arm 72 thereon supporting a plurality of vacuum actuated cups 76 for removing outserts from magazines 22 and carrying them into engagement with containers 14.

Also mounted on the slide block 64 is a mechanical poppet valve 86 connected in fluid communication between vacuum cups 76 and the vacuum source (not shown). Poppet valve 86 is of substantially conventional construction, being normally closed and having a springbiased plunger which can be depressed to vent the vacuum to atmosphere. An adjustable stop 88 is mounted on the support plate 62 to engage poppet valve 86 and thus interrupt the vacuum supply to cups 76 after slide block 64 has reached its fullest extended position and the outserts have been firmly applied to containers 14 so that the slide block and vacuum cups can be withdrawn without disconnecting the outserts.

A shield 89 can be provided between transfer assembly 20 and conveyor 12 for safety purposes.

Referring particularly to FIGS. 2 and 3, magazines 22 are of generally channel-like construction inclined at a suitable angle, such as about 30 degrees for example, to facilitate gravity feed of the outserts stacked therein. As illustrated, three magazines are shown, however, the number of magazines can vary in accordance with the number of containers to which outserts are to be applied simultaneously with each cycle of apparatus 10. The outserts are gently retained in magazines 22 by means of upper tabs 90, which are adjustably supported on a cross bar 92, and lower relatively smaller tabs on the ends of the magazines which have not been shown for reasons of clarity. The cross bar 92 supporting upper tabs 90 is adjustably supported between a pair of posts 94 to allow for adjustment in accordance with the height of the particular outserts and the amount of contact necessary to retain the outserts in the magazines 22 while permitting removal by vacuum cups 76.

In accordance with the preferred embodiment, a glue pot 96 is located between magazines 22 and conveyor 12 beneath the path of pick up arm 72. Glue pot 96 is of substantially conventional construction, including a motorized shaft turning wheels 98 which are partially immersed in hot melt adhesive or other suitable glue. Glue pot 96 is preferably positioned so that the outserts picked up by vacuum cups 76 on arm 72 are brought into rolling engagement therewith for application of sufficient hot melt adhesive prior to engagement with container 14. Since some outserts, labels and the like may already carry contact cement or other adhesive material, the use of glue pot 96 may not be necessary in every application and it will be understood that inclusion of a glue pot is not critical to practice of the invention.

Referring now to FIG. 7 in conjunction with FIGS. 1 and 3, rotation of the pick up arm 72 during reciprocal movement of the slide block 64 is controlled by means of a sprocket or pinion 100 attached to the inner end of the arm. As is best seen in FIG. 7, pinion 100 includes two relatively deep end notches and several intermediate notches adapted to engage drive pins 102 on a fixed bar 104 secured to the inside of support plate 62. As slide block 64 reciprocates on rods 66, the motion of arm 72 is composite: at the extremes, the arm travels linearly to achieve square contact between the suction cups 76, outserts 106 and containers 14; however, during the middle portion of each stroke, the arm rotates under the action of pinion 100 and drive pins 102 in order to bring the outserts into rolling contact with the wheels 98 of the glue pot 96 for application of adhesive before contact with the containers. This motor comprises a very significant feature of the invention.

The outsert applicator apparatus 10 herein operates as follows. Initially, the pick up arm 72 of transfer assembly 20 is in the retracted position with the vacuum cups 76 firmly engaged with the front sides of the leading outserts 106 in magazines 22. Stop pin 48 of gate assembly 18 is extended and photosensors A and B are both blocked to signal that a sufficient number of containers 14 are in position and ready for application of the outserts thereto. The clamp foot 54 of gate assembly 18 extends responsive to contact with a limit switch 108, shown in FIG. 2, by the slide block 64 as it begins to move away from magazines 22 under power from cylinder 68. The outserts 106 are initially pulled by vacuum cups 76 straight away from the magazines 22, but are then rotated downward out from behind retainer clips 90 when pinion 100 engages the end-most drive pin 102. The pinion 100 and middle drive pins 102 continue to rotate the pick up arm 72 and the outserts 106 thereon over the glue wheels 98 until the other end-most drive pin is reached, after which the pick up arm resumes its normal linear course to bring the outserts by their back sides into firm engagement with the containers 14. Poppet valve 86 is opened as slide block 64 reaches its extended position to release vacuum cups 76 so that the pick up arm 72 can be retracted without disconnecting the outserts. After sufficient contact time between the containers 14, outserts 106 and vacuum cups 76, the slide block 64 moves away from its extended position and the poppet valve 86 is allowed to close whereby vacuum is restored to vacuum cups 76 so that the pick up arms 72 can engage another set of outserts from magazines 22 upon reaching the retracted position preparatory to the next cycle.

From the foregoing, it will thus be apparent that the present invention comprises an outsert applicator apparatus having numerous advantages over the prior art. One significant advantage involves the fact that the pick up arm combins rotary motion in the middle of its reciprocal travel to achieve rolling contact between the outserts and the glue wheels, with linear motion at the extremes of its travel to achieve square contact between the vacuum cups, outserts and containers. Adjustability is another important feature in that the apparatus herein can be readily changed over for use with outserts and/or containers of various types and sizes. Other advantages will be evident to those skilled in the art.

Although particular embodiments of the invention have been illustrated in the accompanying Drawing and described in the foregoing Detailed Description, it will be understood that the invention is not limited to the embodiments disclosed, but it is intended to embrace any alternatives, equivalents, modifications and rearrangements of elements falling within the scope of the invention as defined by the following claims.

We claim:

1. Apparatus for applying outserts to containers, comprising:

means for advancing the container along a predetermined input path;

means located along the input path for positioning at least one container to receive an outsert;

magazine means for holding the outserts to be applied, said magazine means being located in spaced relationship wih the input path across from said positioning means;

a glue pot;

transfer means, attached to supporting means, for receiving outserts from said magazine means and applying said outserts to said containers positioned in the input path, said transfer means including:

an arm with a cantilevered portion;

means, attached to said supporting means, for linearly moving and supporting said arm;

means for rotating said arm while said moving means moves said arm linearly;

a cup and means for drawing a vacuum with said cup, said cup supported by the cantilevered portion of said arm, said cup for holding with vacuum said insert as it moves between a retracted position adjacent to said magazine means and an extended position adjacent to said container held by said positioning means; and means for applying glue from said glue pot to said outsert as said outsert is moved by said transfer means;

whereby linear and rotatable movement of said arm by said moving means and said rotating means moves said cup from the retracted position passed said glue applying means to the extended position.

2. Apparatus in accordance with claim 1 wherein said arm rotating means includes a plurality of drive pins secured to said supporting means and a pinion attached to said arm for cooperating with said drive pins.

3. Apparatus for applying outserts to containers, comprising:

means for advancing the containers along a predetermined input path;

means located along the input path for positioning at least one container to receive an outsert;

magazine means for holding the outserts to be applied, said magazine means being located in spaced relationship with the input path across from said positioning means;

a glue pot between said input path and said magazine means;

a support plate extending approximately perpendicularly from the input path and on one side of said glue pot;

means for transferring the outserts from said magazine means to said containers positioned in the input path, said transferring means including:

an arm extending substantially perpendicularly with respect to said support plate;

a cup supported by said arm;

means for drawing a vacuum with said cup, the vacuum of said cup holding an insert as it is received from said magazine means and releasing said insert as it is pressed against a container;

means for driving said arm;

means, supported from a first side of said support plate, for restricting non-rotational movement of said driving means of said arm to linear movement;

means, supported from a second side of said support plate, for rotating said arm as said arm is moved by said driving means; and means for applying adhesive from said glue pot to said outsert as said outsert is moved by said transfer means.

4. Apparatus in accordance with claim 3 wherein said arm rotating means includes a plurality of spaced apart drive pins secured to said support plate and a pinion attached to said arm for cooperating with said drive pins.

5. Apparatus for applying outserts to containers, comprising:

means for advancing the containers along a predetermined input path;

means located along the input path for positioning at least one container to receive an outsert;

magazine means for holding the outserts to be applied, said magazine means being located in spaced relationship with the input path across from said positioning means;

a glue pot located between said magazine means and the container located by said positioning means;

transfer means, attached to supporting means, for receiving the outsert from said magazine means and individually applying an outsert to the container positioned in the input path, said transfer means including:

a pair of spaced apart rails disposed approximately perpendicular with respect to said container path;

a slide block for sliding along said rails;

an arm rotatably supported by said slide block;

a cup and means for drawing a vacuum with said cup, said cup supported by said arm, said cup for holding said insert as it moves between the retracted position adjacent to said magazine means and the extended position adjacent to a container on the input path;

means for linearly moving said slide block, said moving means being coupled to said arm extending from said slide block;

a plurality of drive pins secured to said supporting means;

a pinion attached to said arm for cooperating with said drive pins;

means for applying glue from said glue pot to said outsert as said outsert is moved by said transfer means;

whereby linear movement of said arm by said moving means causes said pinion to engage said pins and rotate said arm thereby resulting in composite linear and rotational cup movement.

* * * * *